United States Patent [19]

Oguchi

[11] Patent Number: 4,491,834

[45] Date of Patent: Jan. 1, 1985

[54] DISPLAY CONTROLLING APPARATUS

[75] Inventor: Tetsuji Oguchi, Tokyo, Japan

[73] Assignee: Nippon Electric Co., Ltd., Tokyo, Japan

[21] Appl. No.: 598,360

[22] Filed: Apr. 12, 1984

Related U.S. Application Data

[63] Continuation of Ser. No. 304,583, Sep. 22, 1981, abandoned.

[30] Foreign Application Priority Data

Sep. 22, 1980 [JP] Japan ..... 55-132009

[51] Int. Cl.[3] ..... G09G 1/16

[52] U.S. Cl. ..... 340/726; 340/723; 340/750

[58] Field of Search ..... 340/723, 726, 744, 748, 340/749, 750

[56] References Cited

U.S. PATENT DOCUMENTS

| | | | |
|---|---|---|---|
| 3,242,470 | 3/1966 | Hagelbarger et al. | 340/726 |
| 3,614,766 | 10/1971 | Kievit | 340/726 |
| 3,742,482 | 6/1973 | Albrecht et al. | 340/726 |
| 4,320,395 | 3/1982 | Meissen | 340/726 |
| 4,375,638 | 3/1983 | O'Keefe | 340/726 |
| 4,386,410 | 5/1983 | Pandya et al. | 340/726 |

*Primary Examiner*—Marshall M. Curtis

*Attorney, Agent, or Firm*—Laff, Whitesel, Conte & Saret

[57] ABSTRACT

A display control system has a memory for storing display information and a memory access circuit for reading display information out of this memory. This memory access circuit includes a first circuit in which a memory address is set, a second circuit for sequentially varying the memory address by a predetermined value, and a third circuit for adding to the memory address a preset value, which is different from the predetermined value. A control circuit gives a designation of the addresses to the memory, as a result of the cooperation of the second circuit and the third circuit. The control circuit can be achieved so that display information is read while a memory address may be varied by at least two different means (the second and third circuits above). Thus, it becomes possible to selectively designate a part of a memory region and to display the information of the selected memory region.

4 Claims, 9 Drawing Figures

DISPLAY CONTROLLING APPARATUS

This is a continuation of U.S. patent application Ser. No. 304,583, filed Sept. 22, 1981, now abandoned.

The present invention relates to a display controlling apparatus, and more particularly to a display controlling apparatus having a control function for feeding video data to a display device such as a CRT or the like.

There are known techniques of displaying character patterns and/or a graphic pattern on a screen of a display device such as a raster scan type CRT (cathode ray tube) by making use of a computer has been well known. This display technique requires preliminarily editing, in a random-access video memory (hereinafter called "video RAM") of information representing characters and/or a graphic pattern, to be displayed on a screen. Furthermore, known techniques require reading the edited information from the video RAM and transferring it to a display device.

In the following specification, unless specifically noted, the information representing characters and/or graphic patterns are simply called "display information". It is to be noted that, as will be explained later, "information representing characters" means address data for a memory in which many character codes are preliminarily stored (hereinafter called "character generator"), whereas "information representing a graphic pattern" means graphic data, per se.

As one of the functions required for display control, a scroll function is known. This is a function for varying a display pattern on a screen. It means, for example, vertically shifting a pattern being displayed on a screen or displacing a part of the pattern to a different location on the screen. Such functions are required when a part of a pattern must be varied while keeping the remaining part of the pattern intact or when a rearrangement of a pattern must be effected. Especially, it is a useful function in graphic display processing or in production of a program list.

However, in the heretofore known display controlling apparatus, a circuit for executing this scroll processing and its control were extremely complex, and hence the display system was not satisfactory. For instance, it had the following disadvantages. Since a period of the scroll control is long, only a display controlling apparatus with high-speed processing capability can be coupled to a display device, and so, the entire system is very expensive. Moreover, there is a large loading upon a control section, which is caused by scroll processing. Thus, it is impossible to make the control section execute other processing (for example, arithmetic operations, program processing or control for other peripheral devices). Therefore, a utilization efficiency is poor. Thus, in order to mitigate loading upon the display controlling apparatus, a control circuit to be used solely for scroll processing becomes necessary.

Furthermore, although scrolling in the vertical or lateral direction on a screen was possible, there was no display control system which could achieve scrolling in an oblique direction, in the prior art. Accordingly, when it was desired to displace, for example, a pattern in an upper left portion on a screen to its lower right portion, it had to be executed by making use of shifts in the lateral and vertical directions, and hence it took a very long period of time. Additionally, the control was also very complex.

It is therefore one object of the present invention to provide a display controlling apparatus which can execute scroll processing with simple control.

Another object of the present invention is to provide an apparatus which enables scrolling in an oblique direction.

Still another object of the present invention is to provide a control circuit which shortens a scroll processing period and simplifies the control means.

Yet another object of the present invention is to provide a display controlling apparatus in which an arbitrary portion of a display pattern is selectively modified at a high speed.

A still further object of the present invention is to provide an apparatus having a novel memory accessing circuit in which a memory address can be changed in a simple manner.

A display control system, according to the present invention, comprises a memory for storing display information and a memory access circuit for reading display information out of this memory. This memory access circuit includes a first circuit in which a memory address is set, a second circuit for sequentially varying the memory address by a predetermined value, and a third circuit for adding to the memory address a preset value, which is defferent from the predetermined value. A control circuit designates addresses, to the memory, as a result of the cooperation between the second and the third circuits.

According to the present invention, the control can be achieved so that display information is read while varying a memory address by at least two means (the second and third circuits above). Whereas, a prior art memory access circuit, cannot selectively designate a part of a memory region by varying the address by only a fixed constant increment. On the other hand, by providing means for varying a memory address according to the present invention, it becomes possible to selectively designate a part of a memory region and to display the information of the selected memory region.

Moreover, as will be described later, the present invention can very easily achieve selection of a pattern positioned at an arbitrary location on a screen by setting a leading address at an arbitrary value in the first circuit and displacing the pattern to a different location on the screen. Accordingly, the invention achieves not only scrolling in the vertical direction on a screen, but also scrolling in an oblique direction.

Furthermore, scrolling a video pattern can be effected by merely modifying memory addresses without rearranging an array of display information in a memory into another array, to which the scrolling is to be effected. Accordingly, a scroll processing period can be shortened and also a loading upon a display controlling apparatus can be mitigated.

In the following, preferred embodiments of the present invention will be described in detail with reference to the accompanying drawings, wherein.

Figure 9:
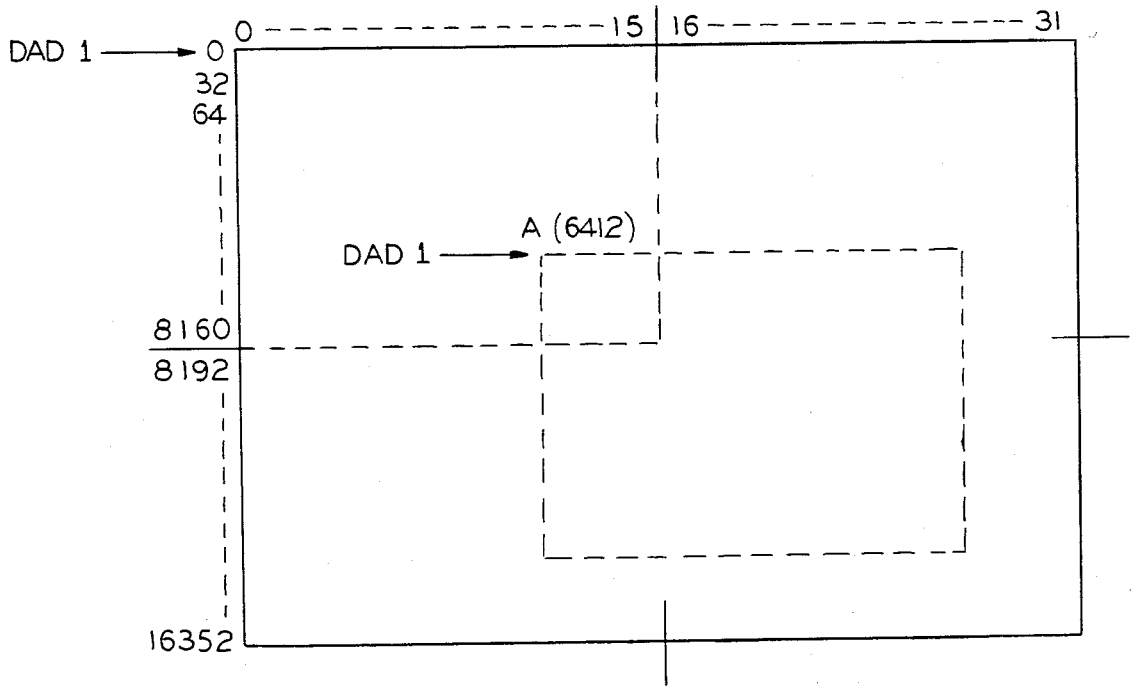

FIG. 9 is a schematic structural view of a video RAM, for explaining the scroll display processing. Now, by way of example, a cathode ray tube (CRT) is employed as one example of display devices. It is assumed that the display screen of the CRT has a 256×256 dot matrix construction. Furthermore, in the display controlling apparatus, it is assumed that display information corresponding to 16 dots aligned along one horizontal scanning line is read out in response to one memory address. Accordingly, a number of addresses to be generated in one horizontal scanning period for scanning a screen in the horizontal direction is 256/16=16. In addition, since there are 256 horizontal scanning lines along the vertical direction, 16×256=4096 memory addresses are required in one video pattern display period.

Figure 1:
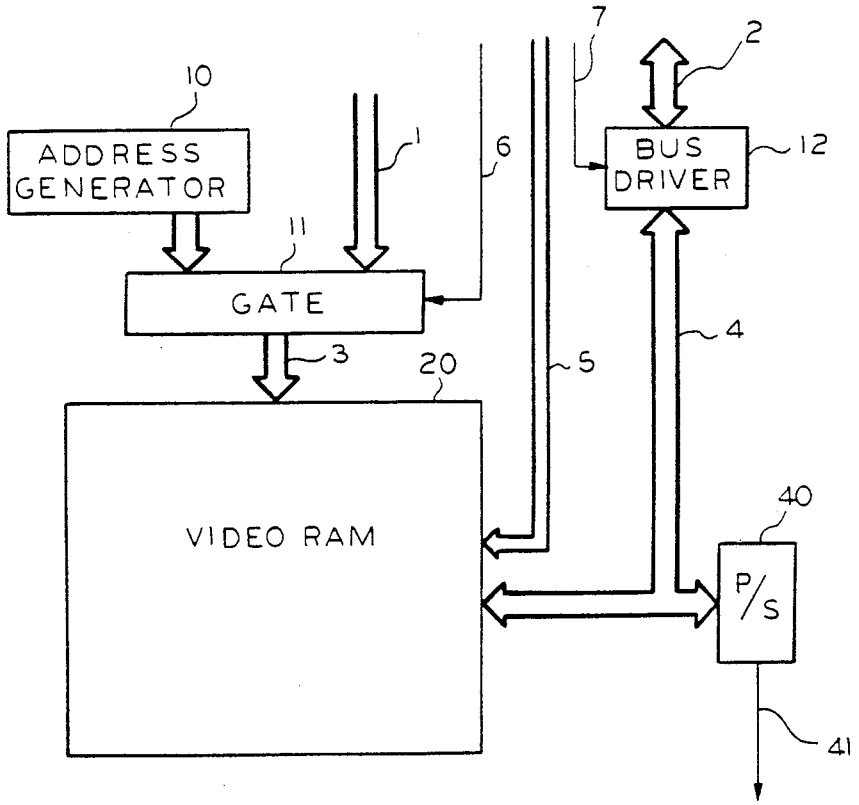
FIG. 1 (PRIOR ART)
FIG. 1 is a block diagram of a display controlling apparatus in the prior art.

At first, FIG. 1 shows a block diagram of a prior art display control circuit including a random access video memory (RAM) 20 and an accessing circuit. By way of example, it is assumed that the video RAM stores graphic data, as display information.

In FIG. 1, a memory address generator 10 is an incrementer having a sufficient number of bits (12 bits) for designating the above-referred 4096 addresses. This generator 10 has a counter in which a count is increased by "1" for every unit time, that is, for one memory addressing period (16 dot display periods). In addition, at the same time as the termination of the display of one video pattern, its count is cleared to "0" in order to be ready for giving a display of the next video pattern.

The generated memory address is input to a transfer gate 11. Another address input of gate 11 is an input for address data 1 fed from a central processor unit (CPU) which is not shown. The CPU carries out a production of graphic data and of writing the produced graphic data in a video RAM. A control signal 6 is generated if the CPU effects a writing operation and stores the produced graphic data in the video RAM (graphic memory) 20, but the data is not output from the memory. The memory address is applied from the address generator 10, via the transfer gate 11. In response to a memory address, a 16-bit, graphic data are output from the video RAM 20 onto a data bus 4, then passed through a parallel-serial converter 40, and transferred to a CRT as a serial graphic signal via conductor 41.

Since the present invention relates to a generation and control of memory addresses, an explanation on a general construction of a display control system is irrelevant, and will be limited to a brief description. In FIG. 1, reference numeral 12 designates a bi-directional bus driver provided for the purpose of isolating a CPU data bus 2 and a video RAM data bus 4 from each other. Reference numeral 7 designates a driver control signal and numeral 5 designates a memory control signal.

Figure 2:
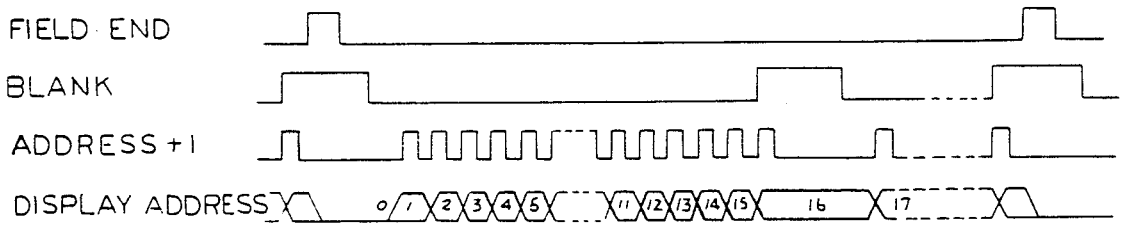
FIG. 2 is an operation timing chart for the prior art apparatus shown in FIG. 1.

FIG. 2 is a timing chart representing various control signals applied to the memory address generator 10 and memory addresses successively generated by the memory address generator 10. The memory address generator 10 is cleared to "0" in response to a FIELD END signal generated by the CPU or the CRT device, upon termination of scanning of every one screen. Further, if the BLANK signal period indicates an out of a display period is at the "H"-level, count processing is not effected and hence the output of the memory address is not varied during the BLANK period. When the BLANK signal becomes the "L"-level and the display is commenced (raster scan starts), the memory address is output, as it is incremented by +1 once in every 16-bit display period.

In this first example of the prior art, if it is intended to scroll a display data, the array of the graphic data, per se, must be modified in the video RAM 20, because the memory addresses are an output from a periodic counter which always starts from 0 and ends at 4095. In other words, the data in the video RAM 20 must be rewritten under control of the CPU, to put the data into an array of a pattern to be displayed after scrolling. Accordingly, this prior art system has a disadvantage because a CPU overhead time becomes long and because a long processing time of the CPU is required for the rewriting.

Figure 3:
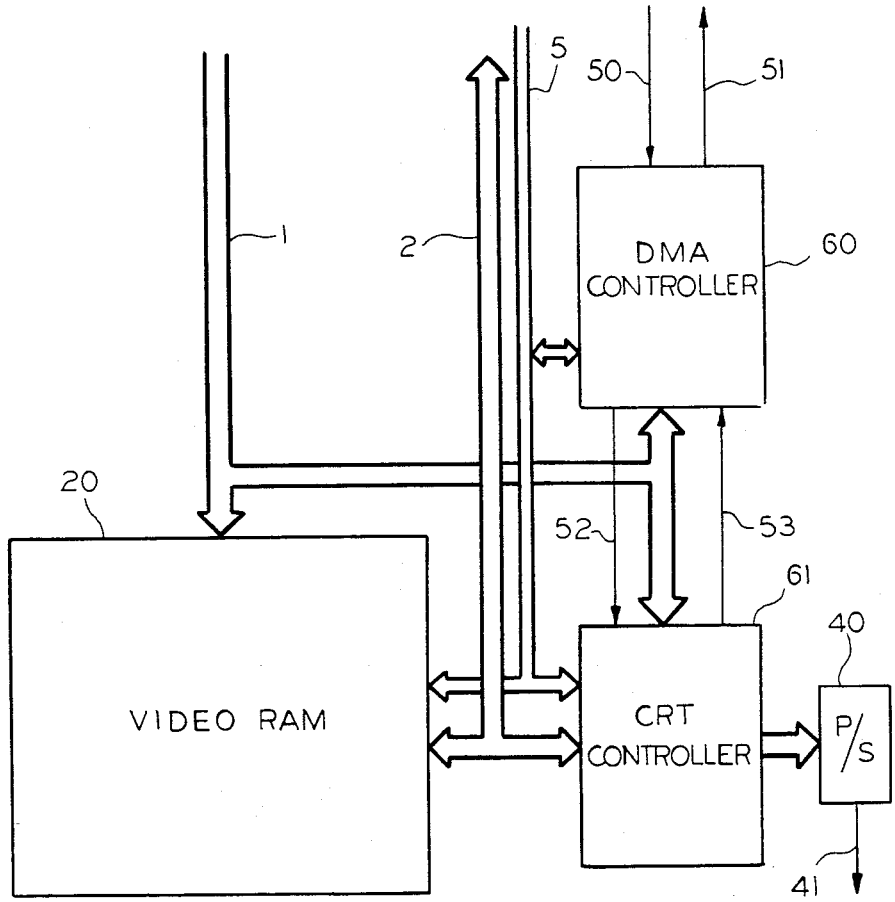
FIG. 3 (PRIOR ART)
FIG. 3 is a block diagram of another display controlling apparatus in the prior art.

A second example of the display control system in the prior art is illustrated in FIG. 3. This prior art is intended to mitigate the loading upon the CPU required for scrolling, by making use of a direct memory access (DMA) controller 60 which accesses a video RAM instead of the CPU. A CRT controller 61 acts as an interface device between the video RAM and a display device.

The leading memory address, upon commencement of a video display, is set in the DMA controller 60 under control of the CPU, each time that the video pattern display is terminated. A DMA demand signal is generated on conductor 53 upon every termination of a display of one line (one horizontal scanning line) in the output from the CRT controller 61 to the DMA controller. The demand signal continues for a period required for the DMA to transfer addresses which are necessary for a display of one line. After the DMA controller 60 has received the DMA demand signal 51, it is forwarded to the CPU for the purpose of using an address bus 1, a data bus 2 and a control bus 5 for graphic data output. As a result, a HOLD approval signal is transmitted from the CPU over conductor 50 to the DMA controller 60, and then the DMA transfer is commenced. At this moment, the DMA controller 60 transmits to the CRT controller 61 a DMA approval signal via line 52, which approval signal represents that the DMA transfer is being executed. When the CRT controller 61 receives the DMA approval signal 52, it determines whether the subsequent DMA transfer exists or not and effects control of the DMA demand signal 53.

When the DMA controller 60 has been started through the abovedescribed procedure in response to a generation of the DMA demand signal 53, the DMA controller 60 applies memory addresses via buses 1 and a memory control signal via buses 5 to the video RAM 20. Of course, the DMA controller 60 has a counter (+1 incrementer) equal to the counter in FIG. 1. Consequently, graphic data accessed by the memory addresses are transmitted to the CRT controller 61 and stored in a one line buffer in the CRT controller 61.

The CRT controller 61 comprises two line buffers (data on one scanning line (256-bit) can be set in either one of them). The data being currently displayed was previously stored in the other line buffer. The data are passed through a parallel-serial converter 40 and output to a CRT as a serial graphic signal via line 41.

Figure 4:
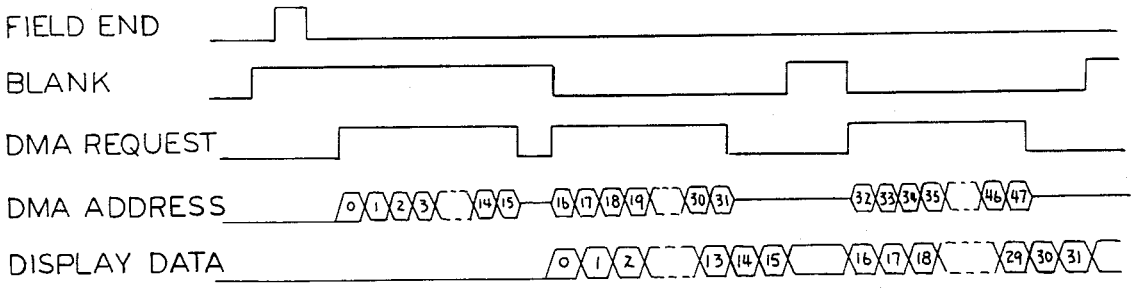
FIG. 4 is an operation timing chart for the prior art apparatus shown in FIG. 3.

FIG. 4 is a timing chart showing addresses which are successively generated from the DMA controller 60 in response to the DMA demand signals and graphic data read out by the addresses. When the FIELD END signal indicates a termination of video display, a leading address "0" for the start of display is set in the DMA controller 60. When the DMA demand signal has been output via wire 53, from the CRT controller 61, the data at the addresses "0" to "15" in the video RAM 20 (the 256-bit data on the first horizontal scanning line) are transferred to the first line buffer contained in the CRT controller 61. As the display is commenced, the contents in the first line buffer are serially output via the parallel-serial converter 40. At the same time, a DMA demand signal on wire 53 causes a reading out, of data displayed on the second scanning line, which is output from the CRT controller 61. As a result, memory addresses ("16" to "31") are generated to indicate where the data to be displayed on the next line (the second horizontal scanning line) are store. The corresponding graphic data are transferred to the second line buffer.

For scrolling in the above-described second example of the prior art system, there are two different methods. The first is a method relying upon rewriting graphic data in a video RAM. This is similar to the first example of the prior art system. The second is a method in which a DMA leading address is modified, and it is executed according to the following procedure.

It is to be noted that in the DMA controller 60 has registers in which at least two different leading addresses can be set. In addition, there are means for successively switching between these registers.

Figure 5:
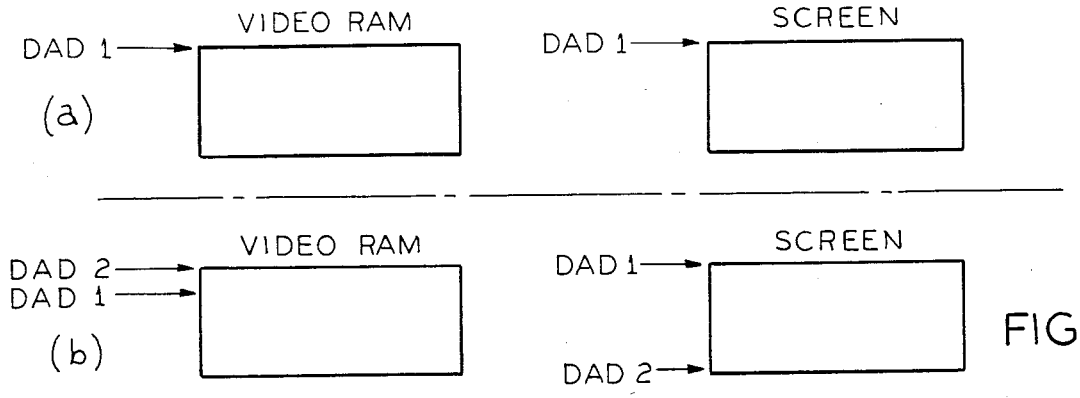
FIG. 5 is diagram showing a correspondence between a video RAM in the apparatus of the prior art and a screen on a display unit, FIG. 5(*a*) showing the correspondence under a normal display condition, while FIG. 5(*b*) showing the correspondence under a scroll display condition.

FIG. 5(*a*) illustrates an access position of a first leading memory address DAD 1 for the video RAM 20 (FIG. 3) and a position on a screen where graphic data accessed by the first leading memory address DAD 1 are to be displayed prior to an occurrence of a scrolling condition. In this case, the DMA leading address is present only once, and data designated by the addresses which are successively generated by incrementing the first leading memory address DAD 1 by "1", are transferred alternately to the two line buffers.

FIG. 5(*b*) illustrates an address position on the video RAM 20 (FIG. 3) and the corresponding display position on the screen in the event that a scrolling condition occurs. In two registers in the DMA controller 60 are set two different DMA leading addresses DAD 1 and DAD 2. As the address DAD 1, a value is obtained by adding to an orginal address valve a number of other addresses, required for a display of one line the addition being completed prior to an occurrence of a scrolling condition. The address DAD 2 is a leading address "0" of the video RAM 20. With regard to the sequence of the generation of addresses, at first the address DAD 1 is output, and subsequently, the content of the register in which the address DAD 1 was set is output while it is successively incremented by "1". When the content of this register (i.e. DAD 1) has become "0", the address DAD 2 in the other register is output to the video RAM 20. Through the above-mentioned operations, scrolling is effected in such manner that the data, originally displayed on the first line of the screen, are displayed on the last line. The data originally displayed on the second and subsequent lines are displayed on the successive lines, shifted upwardly by one line interval, with respect to the original lines as seen in FIG. 5(*b*).

The above-described second scroll processing is very effective, because a virtual scrolling operation is enabled by merely switching addresses, substantially without requiring a rewriting of graphic data in a video RAM as is required in the case of FIG. 1. However, it was impossible to scroll at a high speed since a number of a scrolled line is always "1". When effecting a large scroll in the vertical direction (for instance, in the case where the graphic pattern on the 10th scanning line has to be displayed on the 1st scanning line), it takes 10 times as much as is required in the above-described scrolling. In addition, since scrolling could be effected only for consecutive memory addresses, scrolling in the horizontal direction or in the oblique direction was impossible. Moreover, it was also impossible to move a part of a display pattern, for example a center part, to a different location on a screen, because a leading address set in the register must be a first address in each scanning line.

According to the present invention, it is possible to select a part of a pattern displayed on a screen by using a first circuit to set a leading address, which may be any memory address. A second circuit varies the leading address, successively, and a third circuit adds a preset value to the leading address. Accordingly, not only to scroll in the vertical direction of a screen—but also to scroll in every direction including the horizontal and oblique directions.

Figure 6:
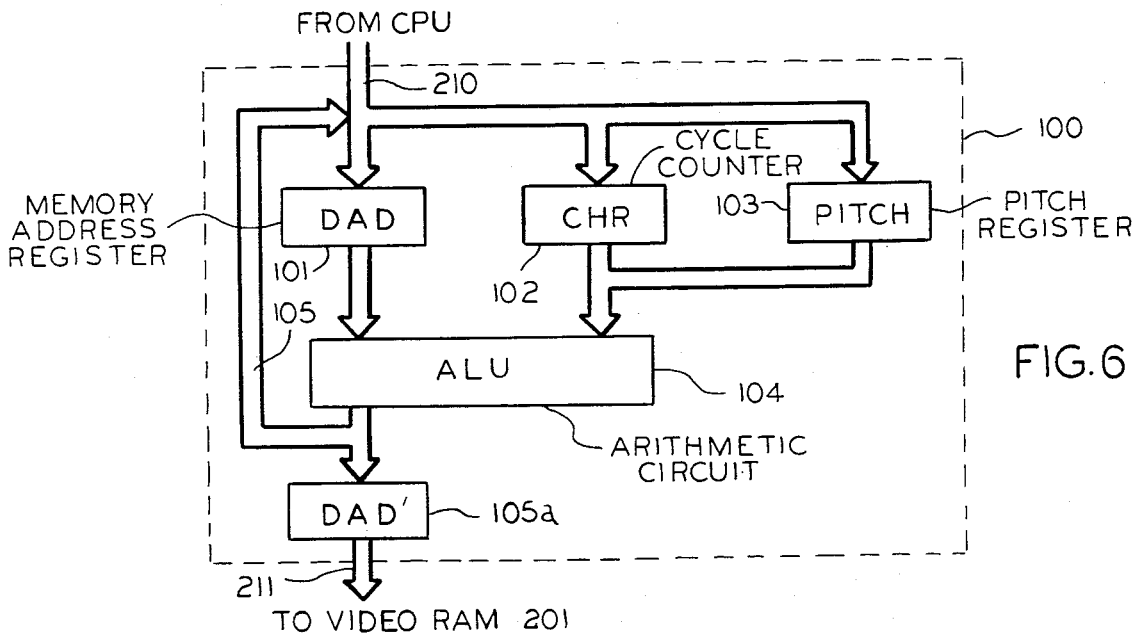
FIG. 6 is a block diagram of a memory address generator in one preferred embodiment of the present invention.

FIG. 6 is a block diagram of a memory address generator 100 (in a memory access circuit) according to one preferred embodiment of the present invention. This memory address generator 100 comprises a memory address register (DAD) 101 for storing a memory address produced by and transmitted from the CPU (not shown). Cyclic counter (CHR) 102 produces data to be used for varying the memory address by a predetermined increment and at predetermined timing, such as an incrementer, a programmable counter, a line counter, etc. A pitch register (PITCH) 103 stores pitch data (preset data produced by and transmitted from the CPU) to be added to the memory address in the memory address register (DAD), in every one horizontal scanning period. An arithmetic circuit (ALU) 104 has an adding function. A register (DAD') 105*a* stores a result of the ALU operation. Upon commencement of a display, a leading memory address is sent from the CPU via a bus 210, and is set in the memory address register (DAD) 101. The counter (CHR) 102 is provided for the purpose of incrementing a memory address one by one, hence it has an increment function of varying the count therein by +1, at predetermined timing which is determined by one memory addressing cycle. The content in counter 102 during the initial condition is "0". Furthermore, in order that the content of the memory address register (DAD) 101 may be varied in every horizontal scanning period (for every one line), predetermined data (pitch data) are sent from the CPU to the pitch register (PITCH) 103 and set therein. When the above-mentioned setting has been finished, read processing of display information (graphic data in the illustrated embodiment) is commenced.

Figure 7:
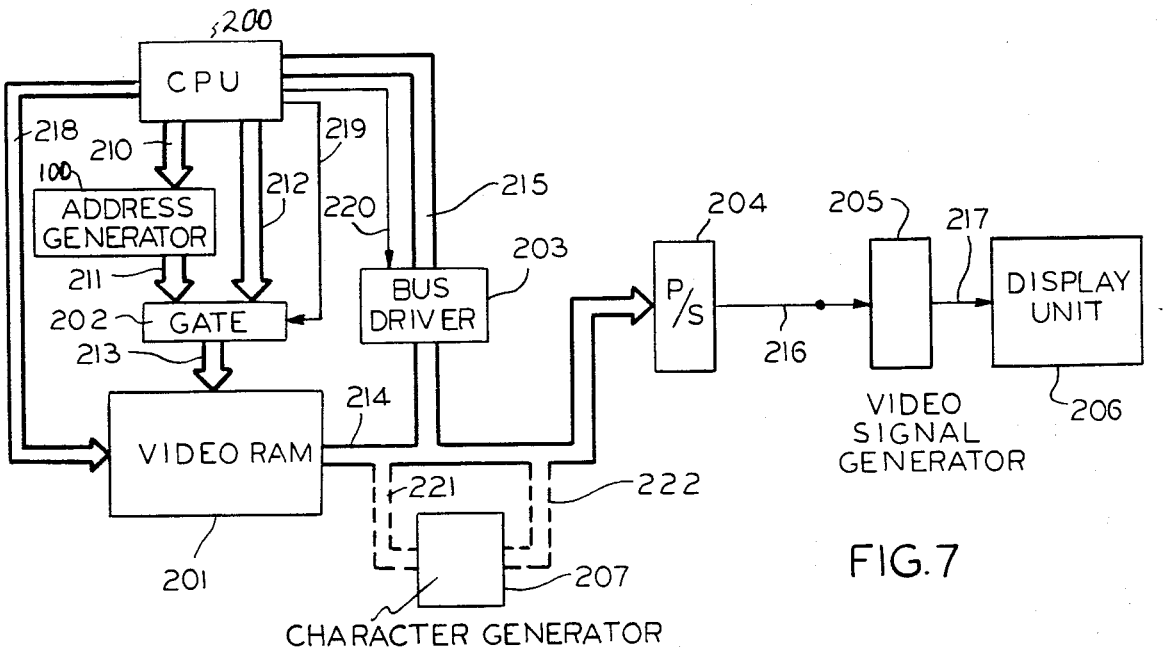
FIG. 7 is a block diagram of a display controlling apparatus according to one preferred embodiment of the present invention employing the memory address generator of FIG. 6 and a display device.

Now the construction and operation of the display controlling apparatus, according to the illustrated embodiment, and the display device will be explained with reference to FIG. 7. The memory address generator 100 illustrated in FIG. 6 is interposed between a CPU 200 and a gate circuit 202. The CPU 200 executes the production of graphic data to be displayed and writes them in a video RAM 201. In this instance, the gate circuit 202 is controlled by a control signal via wire 219 so that a bus 212 and a bus 213 may be coupled to each other. On the other hand, the CPU 200 controls a bus driver circuit 203 by outputting a control signal via wire 220, so that a data bus 215 and a data bus 214 may be connected to each other. As a result, an address from the CPU 200 is directly applied to the video RAM 201 via the buses 212 and 213, and graphic data are written at the appropriate address positions. The graphic data are transferred through the buses 215 and 214. The address applied from the CPU is successively incremented by +1, and consecutively applied to the video RAM 201. The graphic data produced by the CPU 200 are all written in the video RAM 201 in response to this address designation. Of course, a data write control signal is applied to the video RAM 201 through a control data bus 218. Thereafter, when the display start timing occurs, the CPU sets the initial data in the respective registers 101 and 103 and the counter 102 within the address generator 100 in FIG. 6, as described previously.

Now, the capacity of the video RAM 201 is set to be equal to a dot capacity for one screen area. In that case, the construction of the video RAM 201 could be the same as that of the heretofore known video RAM (see FIG. 1) as, described previously. On the other hand, in the memory address register (DAD) 101 (FIG. 6) is set a leading address "0", and the cyclic counter (CHR) 102 is reset to 0.

If the display processing is commenced under such condition, then at first, the content "0" in the DAD register 101 (FIG. 6) and the count 0 in the CHR counter 102 are added together in the ALU 104, and the sum is set in the DAD' register 105*a*. In this case, the result of adding operation is 0. The memory address transmitted to the video RAM 201 (FIG. 7) for the first time is "0". Accordingly, graphic data (data for 16 dots) stored at the memory address 0 are read out, and transmitted to a parallel-serial converter 204 via the bus 214. Consequently, the graphic data are transmitted via a signal line 216 to a video signal generator 205, as serial data of 16 dots. Then, the data are transferred to a display unit 206, as a video signal. The transferred graphic data are displayed at the first 16 dot positions (0–15) along the first horizontal scanning line on the screen. Then, the subsequent operation is a combination of two types of processing, processing-(1) and processing-(2) as explained below.

Processing-(1): The content in the CHR counter 102 (FIG. 6) is incremented by +1. This count is added to the content "0" (the leading address) in the memory address register 101, and the sum is applied to the video RAM 201 (FIG. 7) as the next memory address. Consequently, the next 16-dot graphic data stored at the memory address "1" are read out, and they are consecutively displayed at the next 16 dot positions along the first horizontal scanning line. Thereafter, the count in the CHR counter 102 is successively incremented by +1 in a similar manner. The same processing, as described above, is repeatedly executed until the content in the CHR counter 102 becomes "15". When the content in the CHR counter 12 has become "15", 16-dot graphic data stored at the memory address "15" are read out from the video RAM 201. These data are the data to be displayed at the last 16 dot positions (240–255) on the first horizontal scanning line. Scanning along the first horizontal scanning line is then terminated, and a scanning beam of the CRT returns to a start position on the second horizontal scanning line. This period is generally called the "horizontal blanking period".

Processing-(2): During the horizontal blanking period, a new value (a leading address on the second scanning line) ("16" at this moment), is set in the DAD register 101. To achieve this operation, the value "16" is set in the PITCH register 103 (FIG. 6) by the CPU 200 (FIG. 7). Then, the content of the DAD register 101 storing a leading address "0" on the first scanning line and the content of the PITCH register 103 storing the value "16" are added together in the ALU 104. As a result, the value "16" is obtained and stored in the DAD register 105. Further, this new value "16" is set in the DAD resister 101 via bus 106. The new value "16" is a leading memory address of the second scanning line. It is to be noted that alternatively a content "16" could be set in the DAD register 101 directly from the CPU 200 via the bus 210, without employing the PITCH register 103. Namely, it is only necessary to make a provision such that the value of the leading memory address of the second scanning line is set at the start of scanning along the second horizontal scanning line. By making such a provision, graphic data at the memory address "16" can be displayed at the first 16 dot positions along the second horizontal scanning line. Further, at the start of the third line scanning, the value 16 in the DAD register 101 is added to the value "16" in the PITCH register 103, and then the value "32" is newly set in the DAD' and DAD registers 105*a* and 101. The same operation is executed in the blanking period of each scanning line.

As described above, provided that the above-described processing-(1) is executed in the horizontal period for each horizontal line and the above-described processing-(2) is executed each time the scanning line is changed, graphic data of one display pattern stored in the video RAM 201 (FIG. 7) can be successively and consecutively read out and displayed on the screen. That is, by effecting a control in such manner, the CHR counter 102 may execute a cyclic count operation from "0" to "15", and there may be 255 adding operations which adds a content of DAD register 101 to a content of the PITCH register 103. As a result, the entire data in the video RAM can be displayed.

Next, the CPU 200 produces the value "80" and set it in the DAD register 101 by initial programming. In this condition, when the processing-(1) is executed, the graphic data corresponding to the 5th horizontal scanning line are read out from the video RAM 201. However, the read-out graphic data is displayed in the 1st scanning line. Further, the processing-(2) and the processing-(1) are executed alternately, graphic data in the following 6th scanning line are sequentially read out and continually displayed in the following 2nd scanning line on the screen. Consequently, the scroll of the 5th line and succeeding lines can be easily carried out at high speed.

On the other hand, it control is effected in a manner such that the CHR counter 102 is a programmable counter that may repeatedly execute a count operation from "0" to "7", then only one-half of the stored data can be read out of the video RAM 201. In other words, a pattern consisting of one-half of a regular display pattern can be selectively displayed. Moreover, by setting in the DAD register 101 a memory address corresponding to the first data in the partial pattern to be displayed, a pattern in an arbitrary portion of a regular pattern can be selectively displayed. It is to be noted that, in this case, it is necessary to set a value of (a number of addresses corresponding to one horizontal scanning line)—(a maximum count of the CHR counter 102) in the PTICH register 103.

By making the above-described provision, if the content of the DAD register 101 and the content of the PITCH register 103 are added together upon termination of scanning of every horizontal scanning line, then on the different horizontal scanning lines, the leading dots in the same column of the display pattern can be aligned in the vertical direction. As a matter of course, the number of graphic data read out of the video RAM can be varied by arbitrarily varying the maximum count of the CHR counter 102 and the content of the PITCH register 103. Accordingly, a partial pattern of any arbitrary size can be displayed. In addition, by displaying one-half of a pattern, by repeatedly applying every memory address twice to the video RAM, one-half of a regular pattern can be displayed on a screen as expanded laterally into a double size.

Furthermore, the following describes another preferred embodiment of the present invention in which the scroll processing can be achieved easily, especially a scrolling in the horizontal direction or in the oblique direction. The construction of the display controlling apparatus, per se, may be the same as that shown in FIGS. 6 and 7. However, a video RAM 201 is employed having a size or data capacity which is four times as large as the dot capacity of the display screen. In other words, a video RAM is used which can store graphic data corresponding to four screens. This mode of use is schematically illustrated in FIG. 9.

As shown in FIG. 9, with respect to a display area (1), a video RAM has a memory capacity that is four times as large as the dot capacity of the display area (1). More specifically, in contrast to a number of memory addresses along a horizontal scanning line in a display area (1) (corresponding to one screen) of 16, a number of addresses along a scanning line of a video RAM is set at 32. Furthermore, in the vertical direction also, in contrast to a number of memory addresses in a display area (1) of 256, a number of addresses of a video RAM is set at 512. In this modified embodiment, the content of the PITCH register 103 (FIG. 6) is preliminarily set at "32" by the CPU 200 (FIG. 7). In the video RAM, continuous addresses 0–16383 are assigned so that the display area 1 may be moved by any discrete amount.

Figure 8:
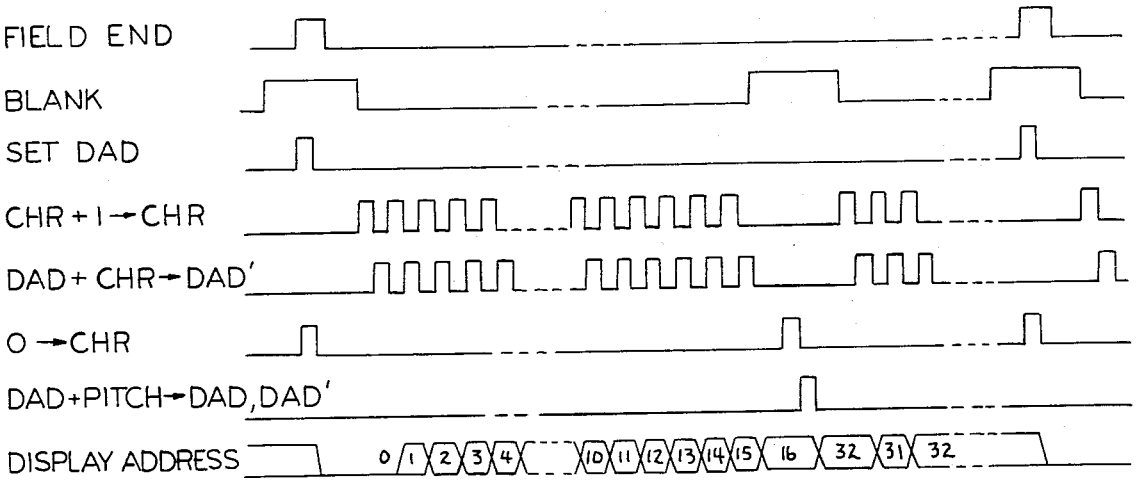
FIG. 8 is an operation timing chart for the display control system shown in FIG. 7.

The operations of the above-described modified embodiment will be explained with reference to a timing chart shown in FIG. 8.

A FIELD END signal is generated by the CPU or the CRT upon every termination of display of one screen. When the FIELD END signal is activated, a first leading address DAD1 is set in the DAD register 101 in the period when a SET DAD signal is at the "H"-level. The address is set under the control of the CPU (FIG. 7), and at the same time the control of the CHR counter 102 (FIG. 6) is cleared to "0". In the event that a display area is selected at the display area (1) in FIG. 9, a value set in the DAD register 101 is "0". During a display period, the content of the CHR counter 102 is incremented by "1" once in each address cycle for the video RAM 201 (FIG. 7). The content is added to the content of the DAD register 101. The result of addition is temporarily stored in the DAD' register 105*a* and thereafter applied to the video RAM 201. During this period, the content of the DAD register 101 is not modified.

When the display for one horizontal scanning line has terminated, the content of the DAD register 101 and the content of the PITCH register 103 are added together. The result of the addition (specifically, 32 because addition of 0+32 is executed) is stored in the DAD register 101 and in the DAD' register 105*a*. Thus the display control system is ready to display the next and subsequent horizontal scanning lines. The above-mentioned operation cycle is repeated until display of one screen is completed. In other words, only the graphic data corresponding to the display area (1) are read out of the video RAM 201 and applied to the CRT of display unit 206.

Alternatively, if the leading memory address DAD 1, set in the DAD register 101 is a value other than 0 (for example, the value 6412), then a graphic pattern can be displayed in a second display area starting from an address point A (6412) as shown by a dashed line box in FIG. 9. As described above, by arbitrarily selected value of the memory address may be initially set in the DAD register 101. Any arbitrary display pattern, contained in the entire pattern stored in the video RAM 201 (FIG. 7), can be selectively displayed.

While the above-described particular example relates to scrolling in an oblique direction, of course it is obvious that, depending upon the selection of the leading address, scrolling may be achieved in either (or both) the vertical or horizontal directions can be also achieved. Furthermore, by making the memory capacity of the video RAM 201 larger than the display dot capacity of the practical display screen, as is the case with the above-described example, it becomes possible to divide a fine pattern such as a circuit diagram, a map, or a finger print. A portion of the divided pattern may be displayed as a partial pattern in an enlarged scale. Moreover it is possible to achieve a scroll display of patterns including a pattern portion surrounding a pattern isolated by the division and a pattern adjacent to the surrounding pattern portion.

It is to be noted that while the above preferred embodiments were described, by way of example, in connection with a graphic display, it is also possible to achieve a scroll display for characters such as letters, symbols or figures. In this instance, character data are preset in a character generator (normally comprising a ROM) 207 in FIG. 7. The video RAM also contains character identification information for selecting a character to be displayed. Accordingly, the character generator 207 is accessed via a bus 221, by reading out the character identification, and character data is read out of the character generator 207 via a bus 222. While the memory capacity of the video RAM was described as being four times as large as the display dot capacity, in the above-described example, the present invention should not be limited to this particular memory capacity, but it could be any number of times equal to or larger than one. Furthermore, it is possible to practice the present invention even if the memory capacity is smaller than the display dot capacity. Further, the present invention can also be applicable to printers, as a display device.

What is claimed is:

1. An apparatus comprising:

display means having a display screen with a plurality of horizontal scanning lines, each horizontal scanning line having a plurality of display locations, memory means for storing the display information which is to be displayed on said display means and having a memory capacity which is larger than a display capacity that can be displayed on the entirety of said display screen, means for writing said display information into said memory means, memory address generator means for generating addresses to read said display information stored in said memory means out of said memory means, said memory address generator means including first address register means for storing an address of a start location on a first horizontal scanning line of said display information which is to be displayed at a display screen, counter means for increasing its content by +1, first adder means for adding the content of said counter means to said address stored in said first address register means to produce a plurality of continuous addresses subsequent to the address stored in said first register, display information stored at locations subsequent to the start location on the same horizontal scanning line being accessed by said plurality of continuous addresses, detecting means for detecting when the number of said continuous addresses produced by said first adder means reaches a predetermined number, second register means for storing data which is to be used to produce a new display start address for a next horizontal scanning line which is positioned below said first horizontal scanning line, said new display start address designating the display information to be displayed at the display start location on said next line, second adder means for adding said data stored in said second register means to said address stored in said first register in response to the output of said detecting means, and means for supplying the output of said second adder to said first register means to change the content of said first register means from the address of a display information to be displayed at a display start location on one horizontal scanning line to the address of a display information to be displayed at a display start location on the next horizontal scanning line, and read-out means for reading out the display information from said memory means at the address designated by said first register means and said first adder means.

2. The apparatus claimed in claim 1, and means for changing the content of said first address register means in each horizontal blanking period of said display unit.

3. An apparatus claimed in claim 1, and means for reusing a single adder circuit means, as said first adder means and as said second adder means, and means for operating said single adder circuit means as said first adder means during each horizontal scanning period and for reoperating said single adder circuit means as said second adder means during each horizontal blanking period.

4. A display system comprising display means for displaying information on a screen, processor means for producing said display information, video RAM means for storing the produced display information, input means for inputting said produced display information into said video RAM means, address generator means for generating a plurality of continuous and discontinuous addresses, reading means for reading out said video RAM means, said read out being display information designated by said plurality of continuous and discontinuous addresses generated by said address generator means, and transferring means for sequentially transferring the read out display information to said display means, said address generator including first means for supplying said video RAM means with a start scrolling address indicating a leading display information which is first to be displayed on one horizontal scanning line on said screen upon a scroll operation, second means for sequentially producing said continuous addresses to designate display information which is to be displayed on said one horizontal scanning line subsequently to said leading display information, said continuous addresses being produced by sequentially adding predetermined incremental data to said start scrolling address during one horizontal scanning period, third means for producing said discontinuous address to designate a leading display information which is first to be displayed on a next horizontal scanning line, said discontinuous address being produced by adding data which is larger than said predetermined increment of data to said start scrolling address during a period between said one horizontal scanning period and said next horizontal scanning period, and fourth means for producing continuous addresses to designate display information which is to be displayed subsequently to said leading display information on the next horizontal scanning line by sequentially adding said predetermined increment data to said discontinuous address during the next horizontal scanning period, whereby a display pattern consisting of a plurality of lines assigned to said video RAM means is shifted to arbitrary locations on said screen of said display means at a high speed.

* * * * *

US004491834B1

REEXAMINATION CERTIFICATE (2999th)

United States Patent [19] [11] B1 4,491,834

Oguchi [45] Certificate Issued Sep. 24, 1996

[54] DISPLAY CONTROLLING APPARATUS

[75] Inventor: Tetsuji Oguchi, Tokyo, Japan

[73] Assignee: Nippon Electric Co., Ltd., Tokyo, Japan

Reexamination Request:
No. 90/003,611, Oct. 21, 1994

Reexamination Certificate for:

| | |
|---|---|
| Patent No.: | **4,491,834** |
| Issued: | **Jan. 1, 1985** |
| Appl. No.: | **598,360** |
| Filed: | **Apr. 12, 1984** |

Related U.S. Application Data

[63] Continuation of Ser. No. 304,583, Sep. 22, 1981, abandoned.

[30] Foreign Application Priority Data

Sep. 22, 1980 [JP] Japan ..... 55-132009

[51] Int. Cl.[6] ..... G09G 5/34

[52] U.S. Cl. ..... 345/123; 345/193

[58] Field of Search ..... 345/123, 200, 345/124, 125, 193, 190; 395/144, 166

[56] References Cited

U.S. PATENT DOCUMENTS 3,614,766 10/1969 Kievit ..... 345/124

4,129,859 12/1978 Iwamura et al. ..... 345/123

FOREIGN PATENT DOCUMENTS 54-80624 6/1979 Japan .

*Primary Examiner*—Richard Hjerpe

[57] ABSTRACT

A display control system has a memory for storing display information and a memory access circuit for reading display information out of this memory. This memory access circuit includes a first circuit in which a memory address is set, a second circuit for sequentially varying the memory address by a predetermined value, and a third circuit for adding to the memory address a preset value, which is different from the predetermined value. A control circuit gives a designation of the addresses to the memory, as a result of the cooperation of the second circuit and the third circuit. The control circuit can be achieved so that display information is read while a memory address may be varied by at least two different means (the second and third circuits above). Thus, it becomes possible to selectively designate a part of a memory region and to display the information of the selected memory region.

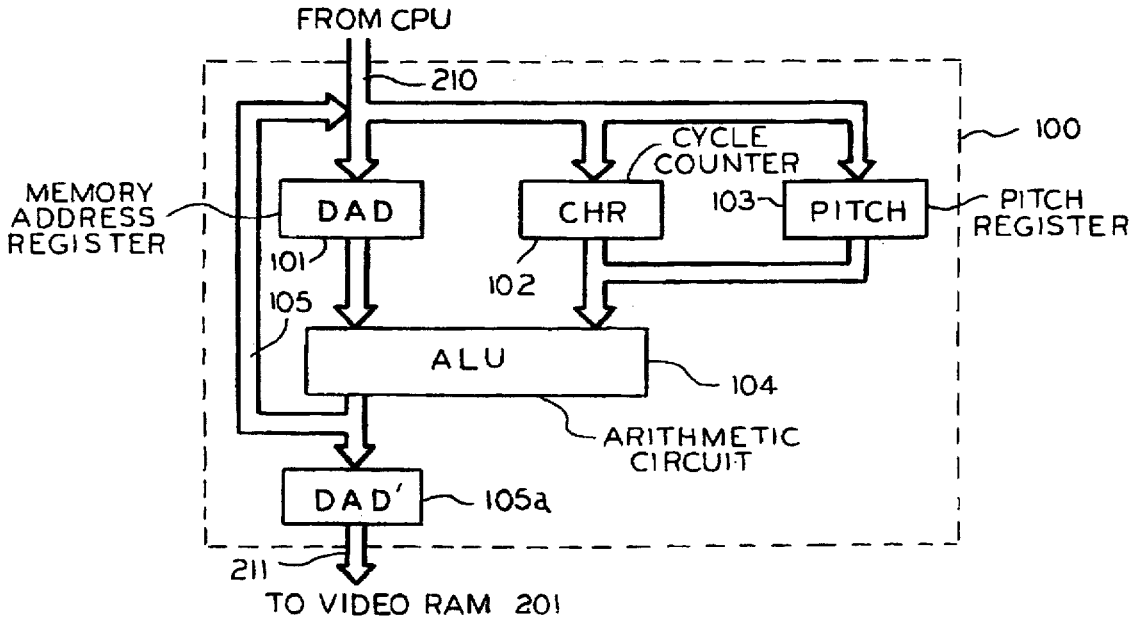

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 8, line 66 to Column 9, line 12:

On the other hand, it control is effected in a manner such that the CHR counter 102 is a programmable counter that may repeatedly execute a count operation from "0" to "7", then only one-half of the stored data can be read out of the video RAM 201. In other words, a pattern consisting of one-half of a regular display pattern can be selectively displayed. Moreover, by setting in the DAD register 101 a memory address corresponding to the first data in the partial pattern to be displayed, a pattern in an arbitrary portion of a regular pattern can be selectively displayed. It is to be noted that, in this case, [it is necessary to set a value of (a number of addresses corresponding to one horizontal scanning line)—(a maximum count of the CHR counter 102)] *the same value of "16" should still be set* in the PTICH register 103.

Column 9, lines 13–28:

By making the above-described provision, if the content of the DAD register 101 and the content of the PITCH register 103 are added together upon termination of scanning of every horizontal scanning line, then on the different horizontal scanning lines, the leading dots in the same column of the display pattern can be aligned in the vertical direction. As a matter of course, the number of graphic data read out of the video RAM can be varied by arbitrarily varying the maximum count of the CHR counter 102 [and the content of the PITCH register 103]. Accordingly, a partial pattern of any arbitrary size can be displayed. In addition, by displaying one-half of a pattern, by repeatedly applying every memory address twice to the video RAM, one-half of a regular pattern can be displayed on a screen as expanded laterally into a double size.

AS A RESULT OF REEXAMINATION, IT HAS BEEN DETERMINED THAT:

The patentability of claims 1–3 is confirmed.

Claim 4 is determined to be patentable as amended.

4. A display system comprising display means for displaying information on a screen, processor means for producing said display information, video RAM means for storing the produced display information, input means for inputting said produced display information into said video RAM means, address generator means for generating a plurality of continuous and discontinuous addresses, reading means for reading out said video RAM means, said read out being display information designated by said plurality of continuous and discontinuous addresses generated by said address generator means, and transferring means for sequentially transferring the read out display information to said display means, said address generator including first means for supplying said video RAM means with a start scrolling address indicating a leading display information which is first to be displayed on one horizontal scanning line on said screen upon a scroll operation, second means for sequentially producing said continuous addresses to designate display information which is to be displayed on said one horizontal scanning line subsequently to said leading display information, said continuous addresses being produced by sequentially adding predetermined incremental data to said start scrolling address during one horizontal scanning period, third means for producing said discontinuous address to designate a leading display information which is first to be displayed on a next horizontal scanning line, said discontinuous address being produced by adding data which is larger than said predetermined increment of data to said start scrolling address during a period between said one horizontal scanning period and said next horizontal scanning period, *said discontinuous address being supplied to said first means as said start scrolling address,* and fourth means for producing continuous addresses to designate display information which is to be displayed subsequently to said leading display information on the next horizontal scanning line by sequentially adding said predetermined increment data to said discontinuous address during the next horizontal scanning period, whereby a display pattern consisting of a plurality of lines assigned to said video RAM means is shifted to arbitrary locations on said screen of said display means at a high speed.

* * * * *